US005488988A

United States Patent [19]

Fukase et al.

[11] Patent Number: 5,488,988

[45] Date of Patent: Feb. 6, 1996

[54] CASTING METAL STRIP

[75] Inventors: Hisahiko Fukase, Tokyo, Japan; William J. Folder, Kiama; Walter Blejde, Balgownie, both of Australia

[73] Assignees: Ishikawajima-Harima Heavy Industries Company Limited, Tokyo, Japan; BHP Steel (JLA) Pty Ltd., Sydney, Australia

[21] Appl. No.: 250,811

[22] Filed: May 27, 1994

[30] Foreign Application Priority Data

May 27, 1993 [AU] Australia ..... PL9060

[51] Int. Cl.[6] ..... B22D 11/06

[52] U.S. Cl. ..... 164/469; 164/480; 164/483

[58] Field of Search ..... 164/428, 480, 164/471, 507, 493, 483, 469, 508

[56] References Cited

U.S. PATENT DOCUMENTS 4,582,531 4/1986 Yoshii et al. ..... 164/493
5,184,668 2/1993 Fukase et al. ..... 164/480
5,259,439 11/1993 Blejde et al. ..... 164/480

FOREIGN PATENT DOCUMENTS 2026911 2/1980 United Kingdom ..... 164/507

*Primary Examiner*—Kuang Y. Lin
*Attorney, Agent, or Firm*—Nikaido, Marmelstein, Murray & Oram

[57] ABSTRACT

Method and apparatus for casting metal strip in which molten metal is introduced between a pair of parallel casting rollers (16) via a tundish (18) and metal delivery nozzle (**19*b*). Casting rollers (16) are cooled so that shells solidify on the moving roller surfaces and are brought together at the nip between them to produce a solidified strip product (20) at the roller outlet. A casting pool is established by pouring a first batch of molten metal at a relatively high temperature above the liquidus temperature of molten metal through the delivery nozzle (19*b*) and is thereafter maintained by pouring through the delivery nozzle (19*b*) a second batch of molten metal at a relatively lower temperature. The bottom of the tundish (18) is formed with a well (26) to hold the first batch of molten metal and there is heating means (8) to heat the metal in the well (26**).

16 Claims, 3 Drawing Sheets

17
48
32
38
46
26
28
40a
47
18
37
24
30
19a
25
19b
13
42
23
11
16
21
20
12

CASTING METAL STRIP

BACKGROUND OF THE INVENTION

This invention relates to the casting of metal strip. It has particular but not exclusive application to casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Twin roll casting has been applied with some success to non-ferrous metals which solidify rapidly on cooling, for example aluminium. However, there have been problems in applying the technique to the casting of ferrous metals. As a consequence of the much slower rate of solidification of ferrous metals, it is absolutely critical to achieve an even cooling and solidification at the casting surfaces to allow continuous casting to proceed satisfactorily. This can be very difficult to achieve, particularly at the commencement of a casting run. Generally it requires that the molten metal be caused to flow through small flow passages formed in refractory material in a metal delivery nozzle. Although the metal delivery nozzle is preheated prior to a casting run, the refractory material around the small flow passages is very prone to localised cooling which can lead to premature solidification of the molten metal, particularly during start-up. It has therefore been necessary to supply the molten metal to the delivery nozzle at temperatures well in excess of the liquidus temperature of the molten metal in order to ensure that none of the metal solidifies prematurely due to localised cooling effects as it passes through the delivery nozzle. Typically, the metal may need at start-up to be preheated so as to have more than 100° C. superheat, i.e. to a temperature more than 100° C. above the liquidus temperature of the metal. Prior to the present invention, in the case of low carbon steels which have relatively high liquidus temperatures, to achieve this and to compensate for heat loss not only at start-up but for the duration of the casting run, the temperature of the molten metal charge upon tapping from the furnace may need to be over 1700° C.

The heating of large quantities of molten metal to temperatures of the above order requires considerable consumption of energy and it also presents obvious problems for operational safety, as well as dramatically curtailing the effective life of the casting rolls and refractory materials, all of the above having a significant effect on operating costs. We have determined that after the initial start-up phase of a casting run, the refractory material of the delivery nozzle is raised uniformly in temperature through heat transfer from the molten metal so that the extremely high temperatures of molten metal are thereafter not necessary to prevent premature solidification. Moreover, we have further determined that such high temperatures also drastically restrict the productivity of the caster in that higher solidification rates can be achieved if the temperature of the casting pool can be lowered.

It has previously been proposed to minimise the superheat of the molten metal in continuous slab casters by supplying supplementary heating to the metal as it flows through a tundish and immersion nozzle to a continuous casting mould in order to prevent premature solidification. U.S. Pat. No. 4,645,534 of D'Angelo et al describes heating of the flowing metal by passing electric current through it from a heating device such as a plasma torch. The heating device may be applied to the metal in the tundish and the current caused to pass through the flowing metal to the immersion nozzle or the mould downstream from the tundish. Japanese Patent J91018979-B (Publication No J59202142) also discloses heating of metal as it flows from a tundish through an immersion nozzle into a continuous casting mould by passing electricity from a plasma torch in the tundish to an anode connected to the immersion nozzle.

The proposals described in U.S. Pat. No. 4,645,534 and Japanese Patent J91018979-B are not directly applicable to twin roll casting of thin strip. The problem of premature solidification in the multiplicity of small flow passages of the delivery system on start-up cannot be overcome by the supply of instant heat during a casting run, because it is not possible to transfer energy into the metal at a sufficient rate or to control the transfer to a degree sufficient to maintain temperatures and therefore flow rates through the flow passages of the delivery systems. The present invention addresses the problem in a different manner by providing a method and apparatus whereby molten metal can be supplied to the delivery nozzle at a relatively high temperature on start-up but at a significantly lower temperature throughout the remainder of a casting run.

SUMMARY OF THE INVENTION

According to the invention there is provided a method of casting metal strip of the kind in which molten metal is introduced into the nip between a pair of casting rolls via a metal delivery nozzle disposed above the nip to create a casting pool of molten metal supported on casting surfaces of the rolls immediately above the nip and the casting rolls are rotated to deliver a solidified strip downwardly from the nip, wherein the casting pool is established by pouring a first batch of molten metal having a first temperature above the liquidus temperature of the metal through the delivery nozzle into the nip between the casting rolls and is thereafter maintained by pouring through the delivery nozzle into the nip between the casting rolls a second batch of molten metal having a second temperature which is less than said first temperature.

Preferably said first temperature is at least 50° C. in excess of said second temperature. It may be at least 100° C. in excess of the second temperature.

Preferably the second temperature is such as to produce a casting pool temperature which is not in excess of 50° C. above the liquidus temperature of the metal. More particularly it is preferred that the second temperature be such as to produce a casting pool temperature which is not in excess of 25° C. above the liquidus temperature of the molten metal.

The molten metal may be molten steel and said first batch may be in the range of 1 to 6 tonnes.

The second batch of molten metal may be at least five times larger than the first batch and may be more than ten times larger.

The first batch of molten metal may be preheated to said first temperature in a tundish disposed above the delivery nozzle and released from the tundish for flow to the delivery nozzle to initiate a casting operation.

The metal may flow from the tundish to the delivery nozzle via a distributor.

The second batch of molten metal may be held in a ladle during the pouring of the first batch of molten metal through the delivery nozzle and subsequently poured from the ladle to continue the supply of molten metal to the delivery nozzle.

The second batch of molten metal may be poured from the ladle into said tundish for flow through the tundish to the delivery nozzle.

The first batch of molten metal may be poured into the tundish from said ladle and thereafter be heated to said first temperature by application of heat to it while it is held in the tundish. Said heat may be applied by plasma arc torch means.

Heat may also be applied to the molten metal of said second batch as it flows from the ladle to the delivery nozzle to maintain the temperature of molten metal in the casting pool above a minimum casting temperature throughout the casting operation. This heat may also be applied to the molten metal as it flows through the tundish, for example by the plasma arc torch means.

The invention further provides apparatus for casting metal strip, comprising:

a pair of casting rolls defining a nip between them;

a metal delivery nozzle disposed above the casting rolls for delivery of molten metal into the nip between the casting rolls;

a tundish for supply of molten metal to said delivery nozzle;

nozzle and tundish preheat means for preheating said delivery nozzle and tundish;

metal preheat means operable to heat a first batch of molten metal in the tundish;

tundish outlet means operable to release a flow of metal from said first batch from the tundish to the delivery nozzle; and ladle means to hold a second batch of molten metal and operable to pour metal of the second batch into the tundish for flow therethrough to the delivery nozzle.

The apparatus may further comprise a molten metal distributor positioned beneath the tundish to receive molten metal from the tundish and supply it to the delivery nozzle.

The plasma arc torch means may have a capacity of the order of 1 Mega Watt.

BRIEF DESCRIPTION OF THE DRAWINGS

In order that the invention may be more fully explained, its application to the continuous casting of steel strip will be explained with reference to the accompanying drawings in which.

DESCRIPTION OF THE PREFERRED EMBODIMENT

In the development of the present invention, initial experimental work was carried out in a metal solidification test rig in which a 40 mm×40 mm chilled block is advanced into a bath of molten steel at such a speed as to closely simulate the conditions at the casting surfaces of a twin roll caster. Steel solidifies onto the chilled block as it moves through the molten bath to produce a layer of solidified steel on the surface of the block. The thickness of this layer can be measured at points throughout its area to produce an overall solidification rate as measured by a parameter generally known as the K factor, defined as $K=1t^{-0.5}$, where 1 is the thickness of metal deposited and t is the time of deposition.

Figure 1:
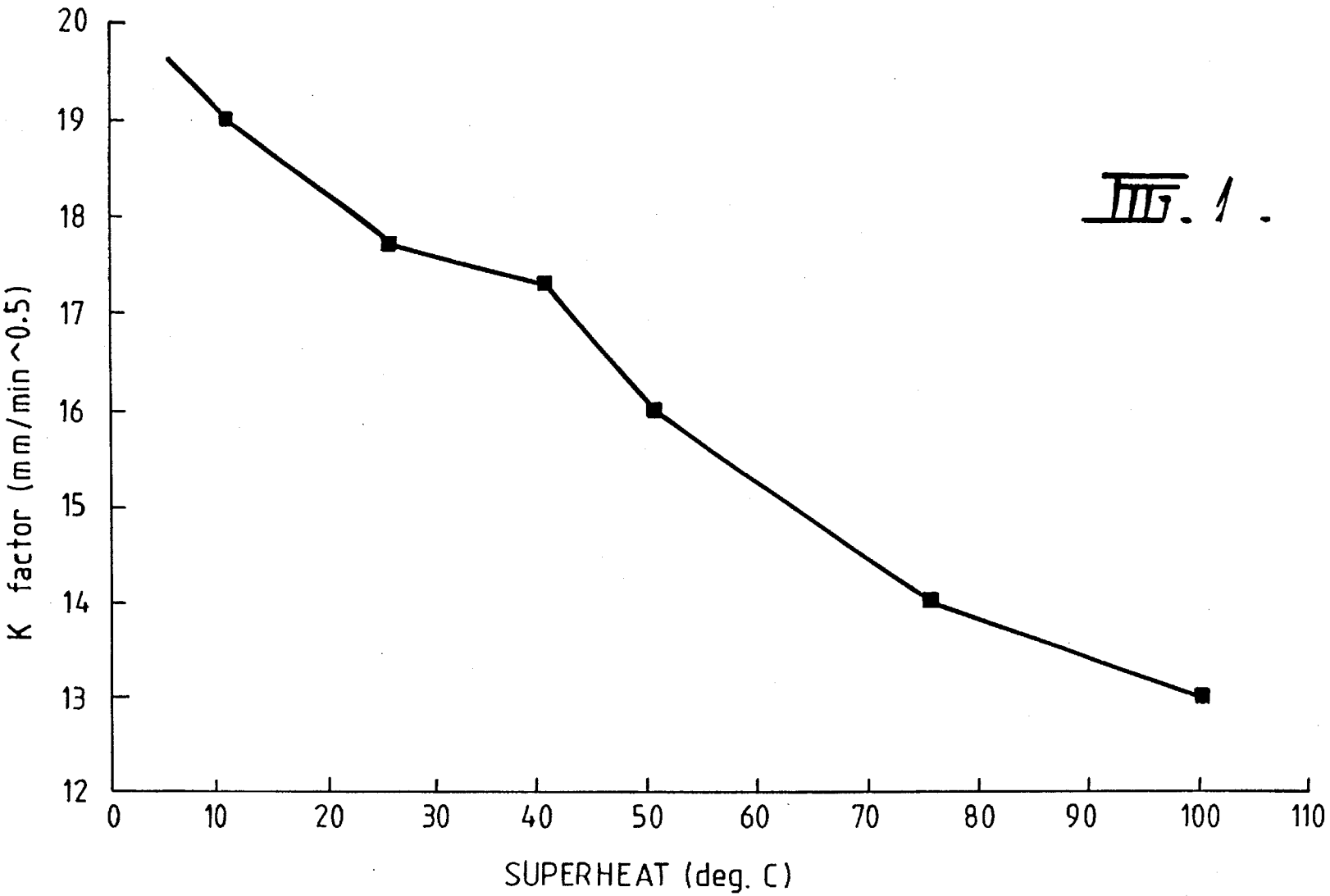
FIG. 1 illustrates the results of experimental work investigating the relationship between productivity and casting temperature of low carbon steel.

FIG. 1 shows the results of experimental work carried out on the above described test rig to determine the effect of casting pool temperature on productivity as measured by the K factor. More specifically this figure shows the K factors measured on one particular substrate for varying melt superheats, i.e. temperatures above the liquidus temperature of the molten metal. It will be seen that the K factor increases very significantly with decreasing melt superheat values which means that the productivity of the caster can be dramatically increased if the temperature of the casting pool can be reduced to no more than about 50° C. of superheat, and preferably to temperatures of less than 25° C. superheat. In some circumstances it is anticipated that it will be possible to allow the casting pool temperature to fall to the liquidus temperature or even just below it to achieve rheocasting conditions. The caster illustrated in FIG. 2 enables continuous casting to proceed with such low melt superheat after an initial start-up phase in which molten metal at a much higher temperature is passed through a delivery nozzle to bring the flow passages in the delivery nozzle up to uniform temperature and to establish the initial casting pool.

Figure 2:
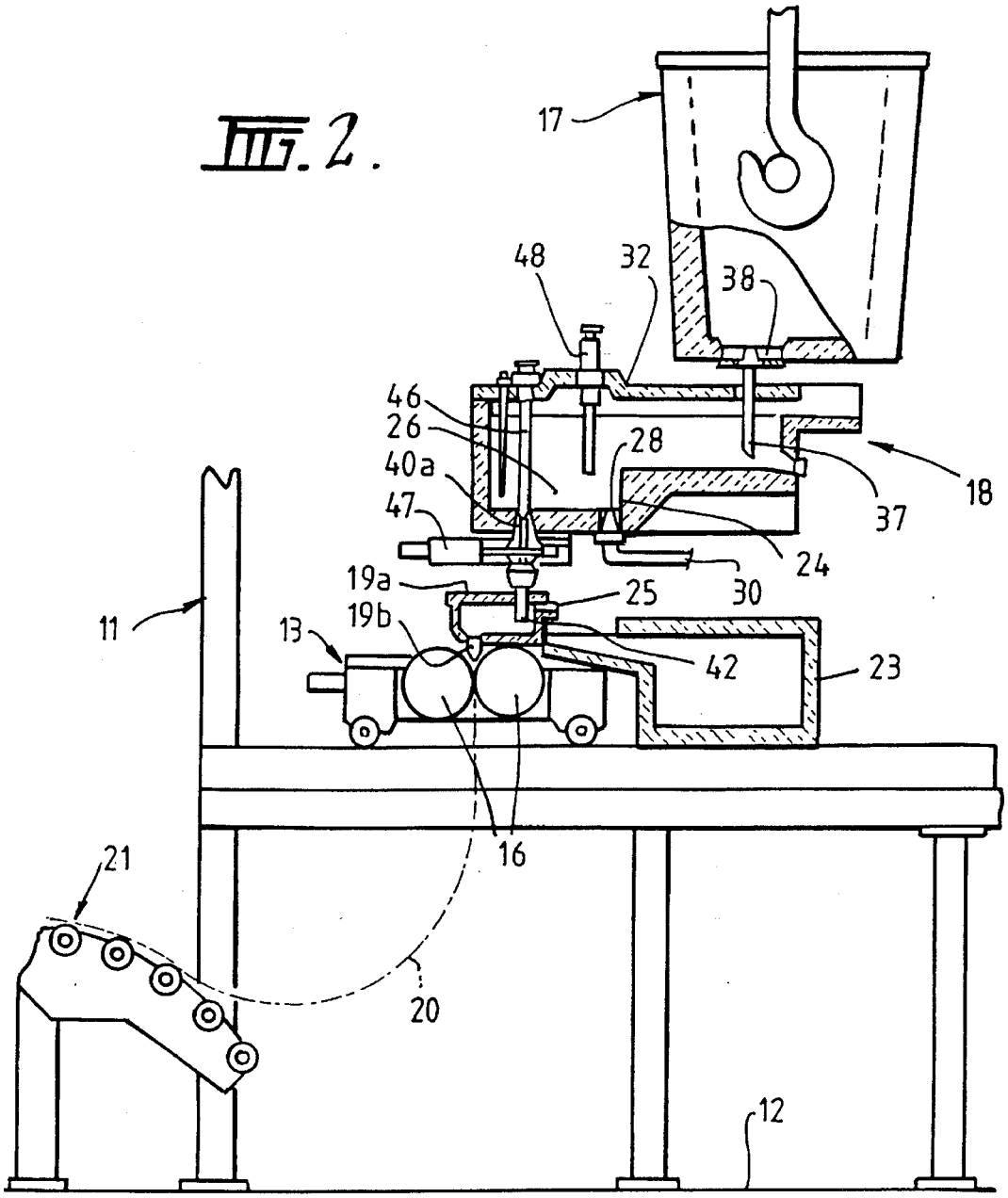
FIG. 2 is a side elevation of a continuous strip caster constructed and operated in accordance with the invention.

The caster illustrated in FIG. 2 comprises a main machine frame, generally identified by the numeral 11, which stands up from the factory floor 12. Frame 11 supports a casting roll carriage is which is horizontally movable between an assembly station and a casting station. Carriage 13 carries a pair of parallel casting rolls 16 which form a nip in which a casting pool of molten metal is formed and retained between two side plates or dams (not shown) held in sliding engagement with the ends of the rolls.

Molten metal is supplied during a casting operation from a ladle 17 via a tundish 18, delivery distributor **19*a* and nozzle 19*b* into the casting pool. Before assembly onto the carriage 13, tundish 8, distributor 19*a*, nozzle 19*b* and the side plates are all preheated to temperatures in excess of 1000° C. in appropriate preheat furnaces (not shown). The manner in which these components may be preheated and moved into assembly on the carriage 13** is more fully disclosed in U.S. Pat. No. 5,184,668.

Casting rolls 16 are water cooled so that molten metal from the casting pool solidifies as shells on the moving roll surfaces and the shells are brought together at the nip between them to produce a solidified strip product 20 at the roll outlet. This product is fed to a run out table 21 and subsequently to a standard coiler. A receptacle 23 is mounted on the machine frame adjacent the casting station and molten metal can be diverted into this receptacle via an overflow spout 25 on the distributor **19*a* or by withdrawal of an emergency plug at one side of the distributor 19***a* if there is a severe malfunction during a casting operation.

In accordance with the present invention tundish 18 is able to hold an initial batch of molten metal which can be preheated to a temperature well above the liquidus temperature to be poured through the delivery nozzle on start-up after which molten metal from the ladle can be poured at a much lower temperature through the same tundish and delivery nozzle into the casting pool.

Tundish 18 is fitted with a lid 32 and its floor is stepped at 24 so as to form a recess or well 26 in the bottom of the tundish at its left-hand and as seen in FIG. 2. Molten metal is introduced into the right-hand end of the tundish from the ladle 17 via an outlet nozzle 37 and slide gate valve 38. At the bottom of well 26, there is an outlet 40 in the floor of the tundish to allow molten metal to flow from the tundish via an outlet nozzle 42 to the delivery distributor 19*a* and the nozzle 19*b*. The tundish 18 is fitted with a stopper rod 46 and slide gate valve 47 to selectively open and close the outlet 40 and effectively control the flow of metal through the outlet.

Well 26 in the bottom of the tundish is provided in order to receive the initial batch of molten metal which is preheated in accordance with the invention to a temperature in excess of the ladle temperature. For this purpose a plasma arc torch 48 is mounted in the tundish lid 32 above well 26 and can be extended downwardly so as to be operable to heat molten metal in the well. An argon gas bubbler unit 28 is installed in the floor of the well and supplied with pressurised argon gas through a pipe 30 to produce bubbles of gas which rise through the molten metal in the well to promote circulation in the region of the plasma arc torch and clear slag from the surface of the metal about the torch. It has been found that best results are achieved if the bubble unit has a pair of closely spaced porous outlets so as to release two closely spaced streams of bubbles which interact to maintain a steady vertically rising sheet of bubbles adjacent the plasma arc torch. If a single outlet is used the resulting single stream of bubbles tends to move about vertically and to break up. Good results are achieved with a gas flow of the order of 44 liters/minute and with the bubbles spaced about 200 mm from the plasma arc torch in a direction away from the tundish outlet 40 and toward the end of the tundish which receives molten metal from the ladle outlet nozzle 37. This ensures that the bubbles rise through the metal before it reaches the plasma arc torch zone in its flow from the ladle outlet nozzle 37 to the tundish outlet 40 so as to promote good circulation around the plasma arc torch zone and within the well 26.

In a typical installation tundish 18 may have a total capacity of about 8 to 11 tonnes, well 26 may have a capacity of about 2 to 4 tonnes and plasma arc torch 48 may be a capacity of the order of 1 Mega Watt.

Figure 3:
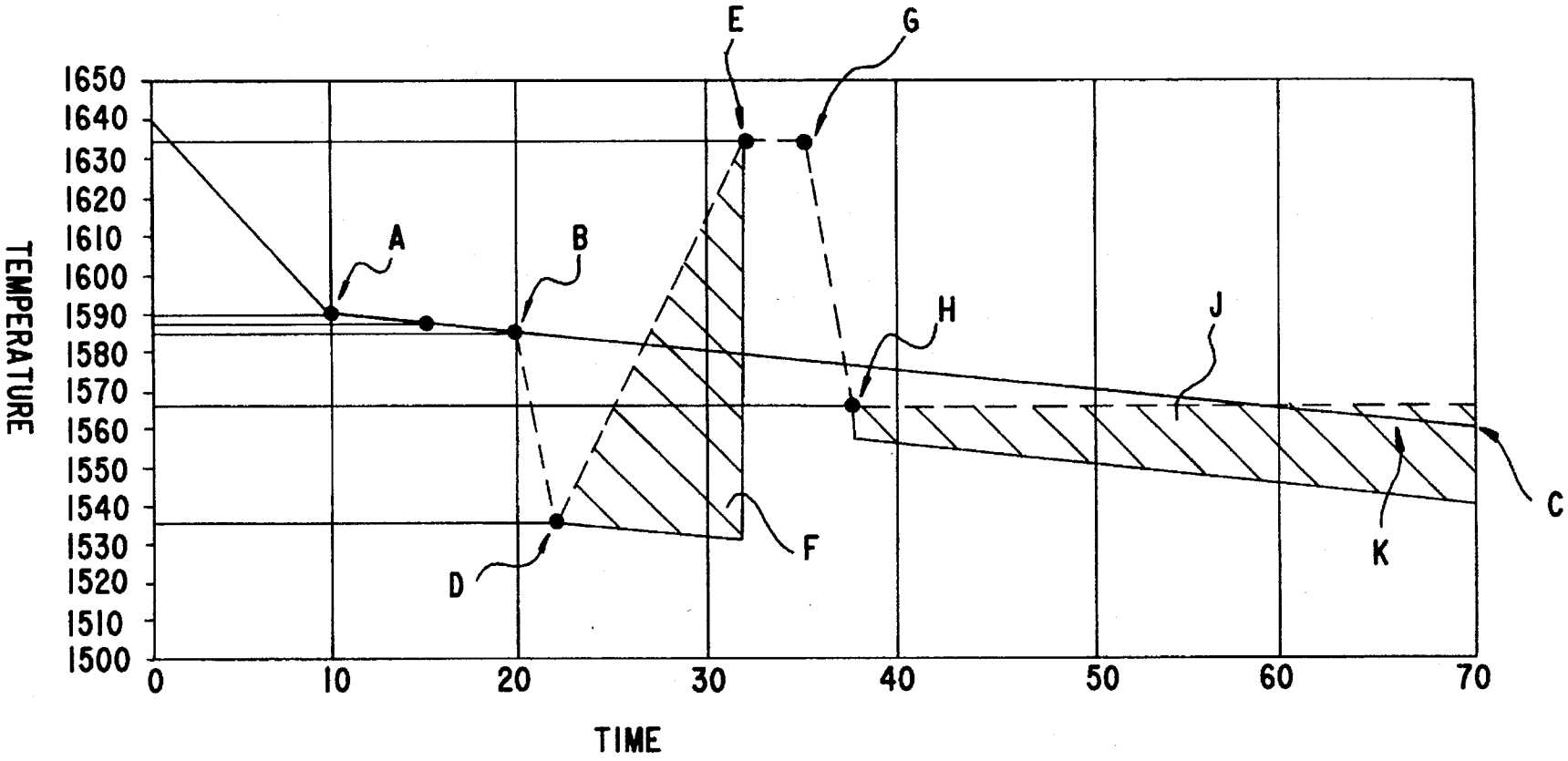
FIG. 3 is a casting schedule for continuously casting steel strip in the apparatus illustrated in FIG. 2.

FIG. 3 is a casting schedule for continuously casting steel strip in the caster as illustrated in FIG. 2, in which the ladle may have a capacity of 30 tonnes. In FIG. 3, the solid line shows the variation of temperature with time for low carbon steel poured from an electric arc furnace into the ladle 17 as it is held in the ladle for the duration of the casting run. The dotted line shows the variation of temperature of metal in the tundish 18.

In a ten minute period required to fill the ladle 17 the temperature of the molten metal falls steadily from a pour temperature of 1640° C. to 1590° C. (point A) and in a following ten minute period required to transport the ladle 17 from the electric arc furnace to the casting position shown in FIG. 2, the temperature of the molten metal falls to 1585° C. (point B). From this point on the solid line records a steady decrease in temperature of the molten metal in ladle 17 to 1560° C. after seventy minutes (point C).

Preparatory to start-up, a batch of about 3 tonnes of molten metal is poured into tundish 18 with the outlet 40 of the tundish closed so that this initial batch collects in the well 26 of the tundish. This takes a period of two minutes during which heat is transferred from the molten metal into the tundish to bring the tundish up to operating temperature. The temperature of the molten metal thus drops from 1585° C. to 1535° C. during this period (point D). The 3 tonne batch of molten metal is then preheated in the tundish well 26 by operation of the plasma arc torch 48 to boost its temperature over a period of ten minutes to about 1635° C. (point E). The hatched area marked F in FIG. 3 is a measure of the thermal energy transferred to the molten metal in the tundish to raise its temperature to this level.

When the initial batch of molten metal in the tundish well 26 has been preheated to a temperature of 1635° C., the tundish outlet 40 is opened to allow the molten metal to flow from the tundish 18 via outlet nozzle 42 to the delivery nozzle 19*a* and into the nip between the casting rolls to establish a casting pool. As the molten metal flows through the narrow flow passages in the delivery nozzle it brings the flow passages up to a uniform temperature while avoiding cooling of any of the metal to temperatures which might produce premature solidification.

When stable casting has been established (point G) the slide gate from the ladle is operated to pour metal from the ladle into the tundish so as to fill the tundish and to maintain a full tundish as casting proceeds. Accordingly molten metal at the ladle temperature mixes with the remainder of the initial batch of higher temperature metal in the tundish so that the temperature of the metal flowing from the tundish drops in the six minute period between the 32nd and 38th minutes from 1635° C. to 1565° C. (point H). At this stage the plasma arc torch is operated to apply heat energy to the molten metal flowing through the tundish from the ladle so as to maintain the temperature of the metal flowing to the delivery nozzle substantially constant at 1565° C. The hatched area J in FIG. 3 is a measure of the thermal energy transferred to the molten metal during this phase of the casting run following the initial start-up. In this regard the bottom line K which extends from the 38th minute to the 70th minute records the temperature profile of the molten metal in the tundish in the absence of any external heating of the molten metal and takes into account that in the absence of external heating the molten metal drops 20° C. between the ladle and tundish during the steady state casting phase.

The application of heat during the continuous casting phase after start-up can be such that the temperature of molten metal in the casting pool is maintained at a temperature only slightly in excess of the liquidus temperature of the metal throughout the whole of the steady state casting run, with dramatically increased productivity. Without the application of heat energy during the steady state casting phase, it would be necessary to allow for a run down of temperature during the casting run, and accordingly to start with a much higher initial melt temperature. It is noted that a substantially constant temperature of molten metal during the steady state phase is preferred, although not essential, and has the advantage of avoiding the adjustment of other casting parameters, such as the rate of rotation of the casting rolls 16 to maintain uniform strip thickness.

The illustrated apparatus enables the casting conditions to be controlled so that during the steady state casting stage after initial start-up, the casting pool can be maintained at close to liquidus temperature to optimise casting productivity. It is thus possible to cast at higher speeds and with smaller diameter rolls than in a conventional caster in which a single charge of molten metal is preheated and poured through the caster with heat losses and temperature run down throughout the duration of the cast. Dramatic improvements in roll life and refractory life are also achieved. In addition it is possible to avoid the need to heat a large melt of metal to excessively high temperatures preparatory to start-up and so significantly reduce operating costs and minimise operational hazards. However, the illustrated apparatus has been illustrated by way of example only and it could be modified considerably. Although it is preferred that the main batch or charge of metal at lower temperature be poured through the tundish in which the initial batch is preheated, this is not essential and it would be possible to have independent supplies of molten metal directed along separate paths to the delivery nozzle. Although a plasma arc torch is a convenient means for applying heat to the molten metal in both the start-up phase and steady state phase, it would be feasible to use other heating means such as an induction coil heater or by addition of chemicals or blowing agents to produce an exothermic reaction in the molten metal. The casting schedule of FIG. 3 shows typical temperatures for casting of a low carbon steel, significantly lower temperatures are possible with other grades of steel such as stainless steels which have much lower liquidus temperatures. It is accordingly to be understood that the invention is in no way limited to the details of the illustrated apparatus and casting schedule and that many modifications and variations will fall within the scope of the appended claims.

We claim:

1. A method of casting metal strip comprising:

initiating casting by introducing, through a delivery nozzle, a first batch of molten metal having a first temperature into a nip formed between a contra-rotating pair of casting rollers to form a casting pool having a casting pool temperature, casting a strip of metal by passing a first portion of the first batch of molten metal between the casting rollers, adding to the casting pool, through the delivery nozzle, a second batch of molten metal having a second temperature , wherein the second batch of molten metal and the first batch of molten metal are substantially the same molten metal, and wherein the second temperature is less than the first temperature, and continuing the casting step using a remaining portion of the first batch of molten metal and the second batch of molten metal to produce a continuous casting strip, wherein the first temperature is at least 50° C. greater than the second temperature and the second temperature is such as to reduce the casting pool temperature to less than 50° C. above the liquidus temperature of the molten metal.

2. The method as claimed in claim 1, wherein the first temperature is at least 100° C. greater than the second temperature.

3. The method as claimed in claim 1, wherein the second temperature is such as to reduce the casting pool temperature to less than 25° C. above the liquidus temperature of the molten metal.

4. The method as claimed in claim 1, further comprising, before the introducing step, preheating the delivery nozzle to a temperature in excess of 1000° C. in a preheat furnace.

5. The method as claimed in claim 1, wherein the first batch of molten metal weighs between 1 and 6 tonnes.

6. The method as claimed in claim 1, wherein the first batch of molten metal weighs between 2 and 4 tonnes.

7. The method as claimed in claim 1, wherein the second batch of molten metal weighs at least five times more than the first batch.

8. The method as claimed in claim 1, further comprising, before the introducing step, heating the first batch of molten metal to the first temperature in a tundish, wherein the tundish is disposed above the delivery nozzle and connected to the delivery nozzle to produce a heated molten metal product, and releasing the heated molten metal product from the tundish for flow to the delivery nozzle.

9. The method as claimed in claim 8, wherein the flow is controlled by a distributor.

10. The method as claimed in claim 8, further comprising holding the second batch of molten metal in a ladle and releasing, during the introducing step, the second batch of molten metal from the ladle into the tundish for flow through the tundish to the delivery nozzle thereby providing continuous supply of molten metal to the delivery nozzle.

11. The method as claimed in claim 8, further comprising, before the heating step, releasing the first batch of molten metal into the tundish from a ladle located above the tundish.

12. The method as claimed in claim 10, further comprising heating the second batch of molten metal as the second batch of molten metal flows through the tundish.

13. The method as claimed in claim 8, further comprising, before the heating step, releasing the first batch of molten metal into the tundish from a ladle located above the tundish, holding the second batch of molten metal in the ladle and releasing, during the introducing step, the second batch of molten metal from the ladle into the tundish for flow through the tundish to the delivery nozzle thereby providing continuous supply of molten metal to the delivery nozzle, and wherein the first batch of molten metal is heated by a plasma arc torch.

14. The method as claimed in claim 13, further comprising heating the second batch of molten metal as the second batch of molten metal flows through the tundish, wherein the heat is applied by a plasma arc torch and wherein the heat is sufficient to maintain the casting pool temperature above a minimum casting temperature throughout the production of the continuous casting strip.

15. The method as claimed in claim 4, wherein the molten metal is molten steel.

16. The method as claimed in claim 1, wherein the molten metal is molten steel.

* * * * *